United States Patent [19]

Kitazawa

[11] Patent Number: 5,056,567

[45] Date of Patent: Oct. 15, 1991

[54] MECHANISM FOR GUIDING SHUTTLES IN A CIRCULAR LOOM

[75] Inventor: Makoto Kitazawa, Kyoto, Japan

[73] Assignee: Torll Winding Machine Co., Ltd., Kyoto, Japan

[21] Appl. No.: 517,113

[22] Filed: May 1, 1990

[30] Foreign Application Priority Data

May 2, 1989 [JP] Japan ..... 1-113489

[51] Int. Cl.[5] ..... D03D 37/00

[52] U.S. Cl. ..... 139/457; 139/192

[58] Field of Search ..... 139/457, 192, 458, 459, 139/14, 15, 16

[56] References Cited

U.S. PATENT DOCUMENTS 3,871,413 3/1975 Torri ..... 139/459
4,355,666 10/1982 Torri ..... 139/457 X
4,424,836 1/1984 Torri ..... 139/457
4,432,397 2/1984 Cacciapuoti ..... 139/457
4,619,293 10/1986 Huemer ..... 139/457
4,776,371 10/1988 Schonberger et al. ..... 139/457

*Primary Examiner*—Andrew M. Falik

[57] ABSTRACT

A mechanism for guiding a shuttle in a circular loom having shuttles provided with a plurality of rotatable supporting wheels moved along a circular running passage. Wefts taken out from each shuttle are inserted into successive sheds of warps created immediately before the arrival of the shuttle and are interwoven with the warps to form a tubular fabric. The circular running passage is defined by at least one annular guide surface created by an element guide surface of each reed element of an annular reed member of the circular loom. The running passage of each of the supporting wheels is restricted by a corresponding one of the annular guide surfaces located at a corresponsing position. Possible pressing of the warps against the upper and lower annular edge portions of the annular reed member by the supporting wheels is prevented.

4 Claims, 7 Drawing Sheets

MECHANISM FOR GUIDING SHUTTLES IN A CIRCULAR LOOM

BACKGROUND OF THE INVENTION

1. Field of the Invention

The present invention relates to a mechanism for guiding shuttles in a circular loom.

2. Description of the Related Art

In a conventional circular loom, a shuttles are moved along a circular running passage and a weft taken out from each shuttle is inserted into successive sheds created before the arrival of the shuttle, and the weft is interwoven with warps to form a tubular fabric, as disclosed by U.S. Pat. No. 4,424,836. This type of conventional circular loom has a serious problem, in that the wheels rotatably mounted to the shuttle run on the corresponding annular guides which form the circular running passage, while running on warps radially crossing the circular running passage. Therefore, if the material of the warp yarn is a material having a weak resistance to abrasion, such as a carbon fiber, often the material is damaged by the action of the above-mentioned wheels of the shuttles. Therefore, as there is now a growing tendency to produce a circular fabric by a material having a weak resistance to the above-mentioned abrasion, particularly for producing an industrial fabric, the above-mentioned problem has become very serious in view of the need to supply tube fabrics for industrial use which have strong mechanical properties.

SUMMARY OF THE INVENTION

Therefore, an object of the present invention is to provide a circular loom by which the above-mentioned problem is eliminated in which the above-mentioned problem does not arise. Namely, the main object of the present invention is to provide an improved mechanism for guiding shuttles in a conventional circular loom.

To attain the above-mentioned object, in the present invention applied to a conventional circular loom provided with a central vertical driving shaft, comprising a shed forming means formed by healds and means for actuating the heads, a weft filling means formed by an annular reed member provided with a plurality of vertical reed elements arranged at an identical spacing between each two adjacent reed elements, means for propelling shuttles for inserting into successive sheds, means for supplying warps to the shed forming means, means for continuously taking out the tubular fabric, each vertical reed element having a predetermined thickness with respect to the radial direction of the annular reed member, having a required shape, a recessed portion or portions by which at least a single guide passage defining a passage for the corresponding wheel of the shuttle is (are) formed inside the annular reed member in such a manner that the warp yarns are not pressed by the wheel(s).

DESCRIPTION OF THE PREFERRED EMBODIMENTS

Before explaining the preferred embodiment of the present invention, to facilitate an easy understanding the present invention, the mechanism and function of the conventional circular loom is briefly explained with reference to FIGS. 1, 2, 3, and 4.

Figure 1:
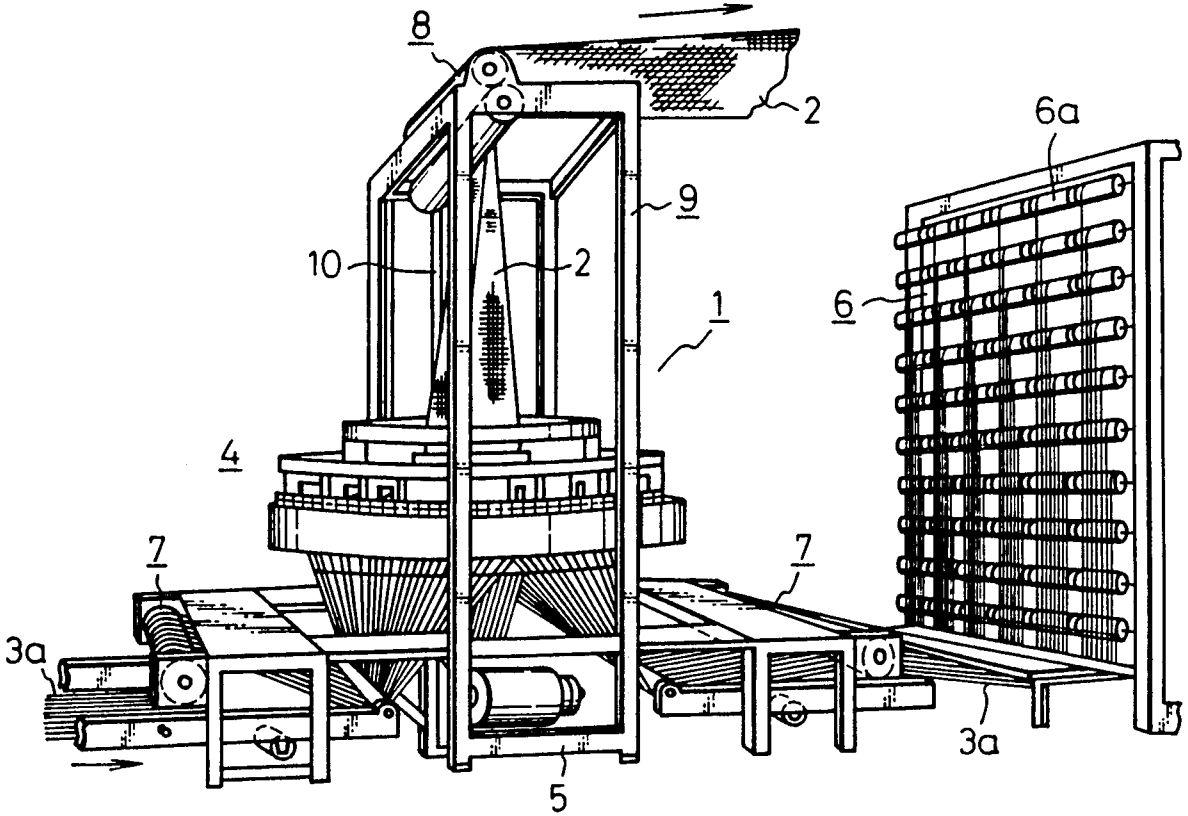
FIG. 1 is a schematic perspective view of a conventional circular loom to which the present invention can be applied.

In the circular loom 1 shown in FIG. 1, a main part 4 including a shed forming means and filling means is mounted within a frame 9, and the shed forming means and filling means are driven by an electric motor 5 located below the main part 4 through a first power transmission mechanism (not shown). A tubular fabric take-out means 8, mounted on the frame 9 above the main part 4, is driven by a second power transmission mechanism (not shown) connected to the take-out means 8 and driven synchronously with the main part 4. Warps 3*a*, FIG. 2, of a number needed for weaving a required tubular fabric 2, are fed by a pair of creels 6 located on opposed sides of the main part 4, symmetrically with each other respect to the main part 4, (only one creel located on the right side is illustrated in FIG. 1), from a plurality of yarn packages 6*a* mounted rotatably for feeding warps, and are fed to the main part 4 through a warp feed mechanism 7. The tubular fabric 2 formed by the weaving operation in the main part 4 of the circular loom 1 is taken out upwardly by the take-out means 8 and guided to a winding means (not shown), in a direction indicated by an arrow.

Figure 2:
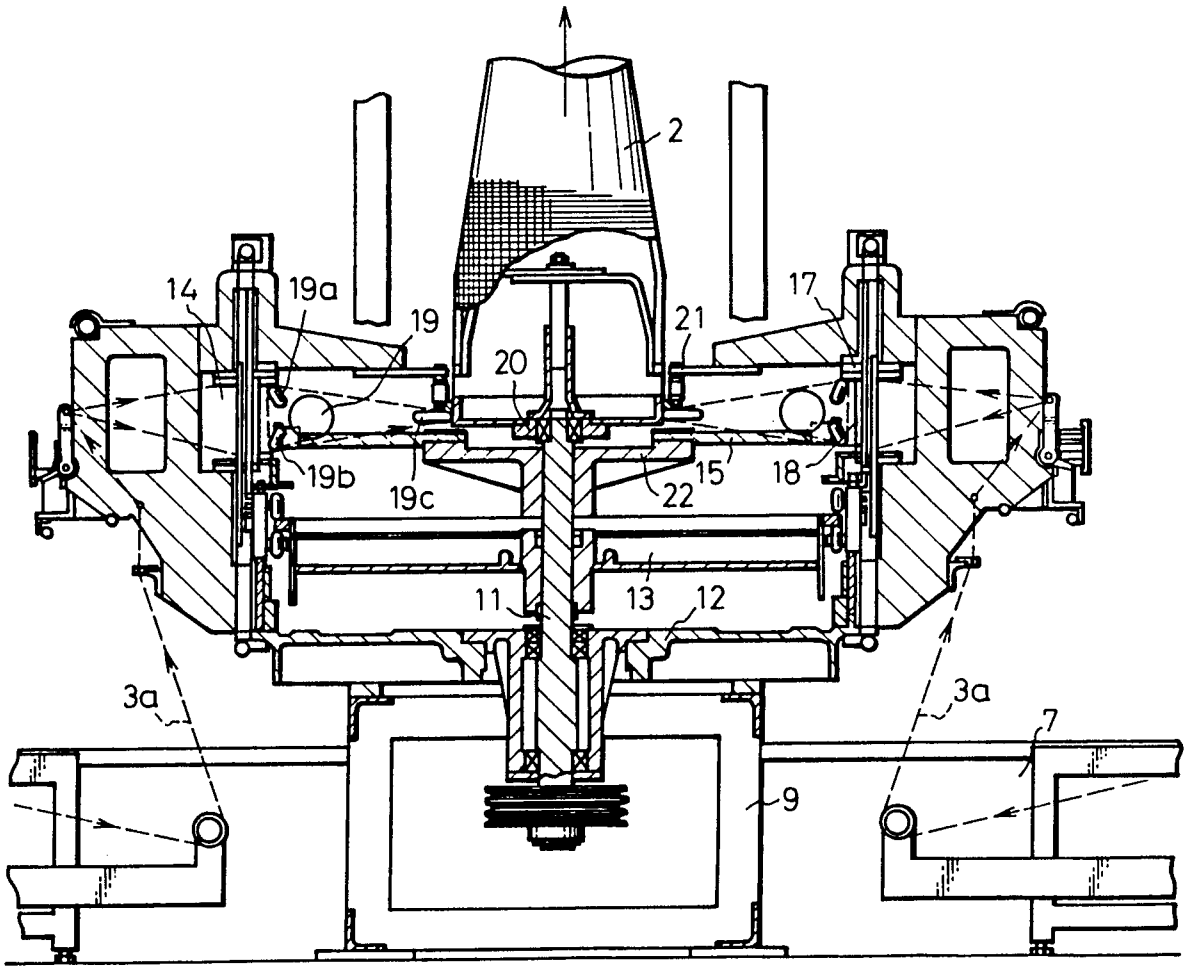
FIG. 2 is schematic view of the main part of the circular loom shown in FIG. 1.
Figure 5:
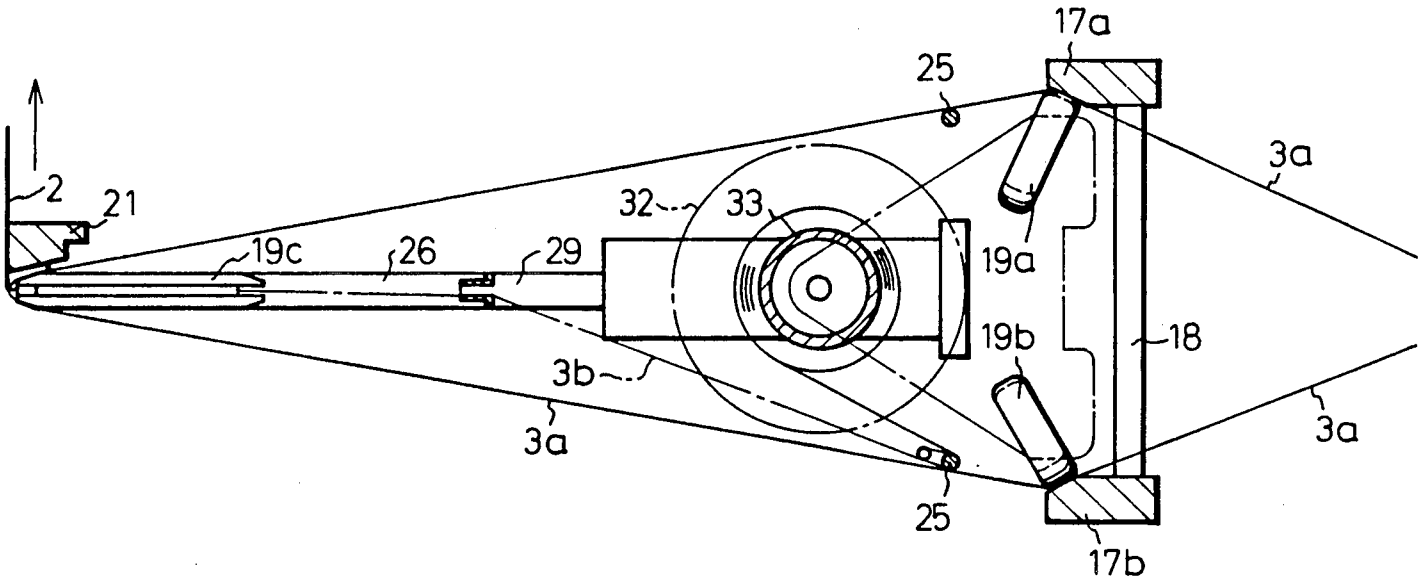
FIG. 5 is a schematic front view of the shuttle shown in FIG. 3, when inserted in a shed.
Figure 6:
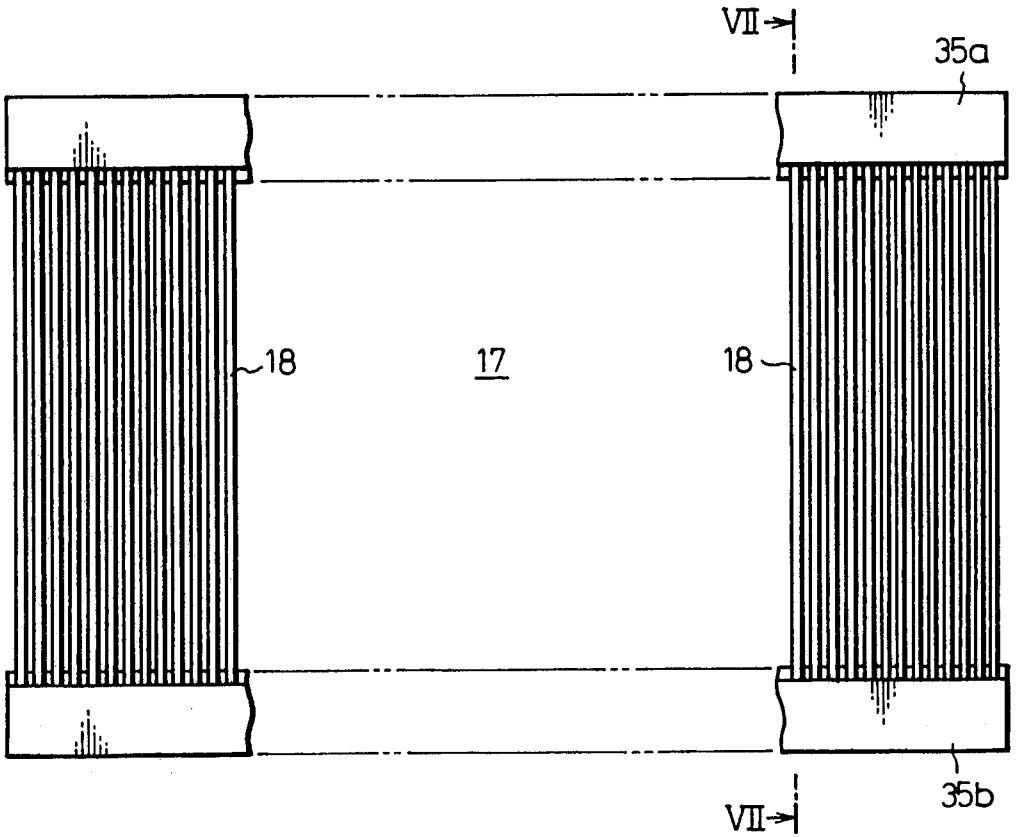
FIG. 6 is a partial view of an annular reed member, in an extended condition, according to the present invention.
Figure 8:
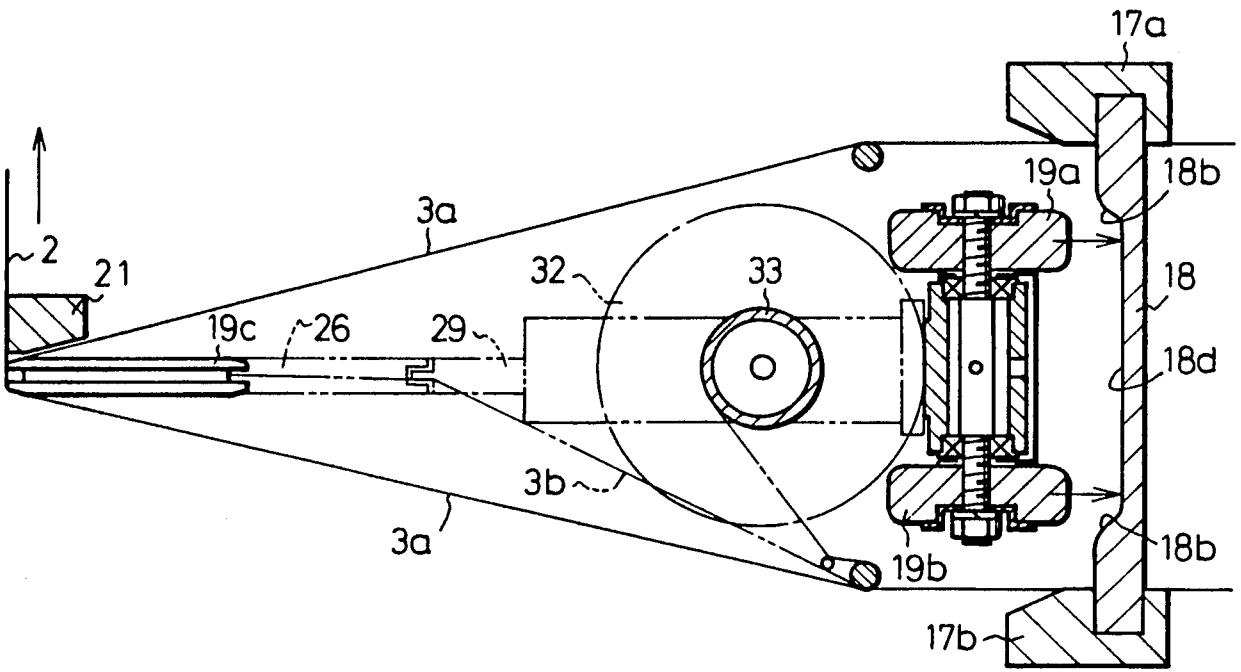
FIG. 8 is a schematic front view of a shuttle in a shed according to the present invention, showing a predetermined annular passage formed in the annular reed member for guiding the running of a shuttle; and, FIGS. 9 and 10 show other embodiments of the reed element of the annular reed member according to the present invention.

As shown in FIGS. 1 and 2, the main part 4 of the circular loom 1 is provided with a vertical shaft 11, FIG. 2, rotatably supported on bearings fixed to a central opening of a supporting frame 12 secured to the frame 9. A cylindrical cam mechanism 13 is fixed to the shaft 11 at a position above the supporting frame 12. A shed forming mechanism 14 is operated by the cylindrical cam mechanism 13. Four shuttle propelling mechanisms 15 fixed to a supporting mechanism 16, FIG. 2, fixed to the shaft 11 at a position above the cylindrical cam mechanism 13. An annular reed member 17 comprising a pair of ring-shaped holding members 17*a*, 17*b* (FIGS. 4, 5 and 7) and a plurality of reed elements 18, FIG. 6, is rigidly supported by the ring shaped holding members 17*a*, 17*b* in a vertical state with an identical spacing between each two adjacent reed elements. A horizontal disc guide member 20, is secured to the shaft 11 and is supported rotatably on the top of the shaft 11 to guide wheel 19*c* of a shuttle 19, FIG. 2. An annular guide 21 is held in a stationary position by supporting arms 21*a*, with a small clearance between wheel 19*c* and the top end of the annular edge of the horizontal disc guide member 20.

Figure 3:
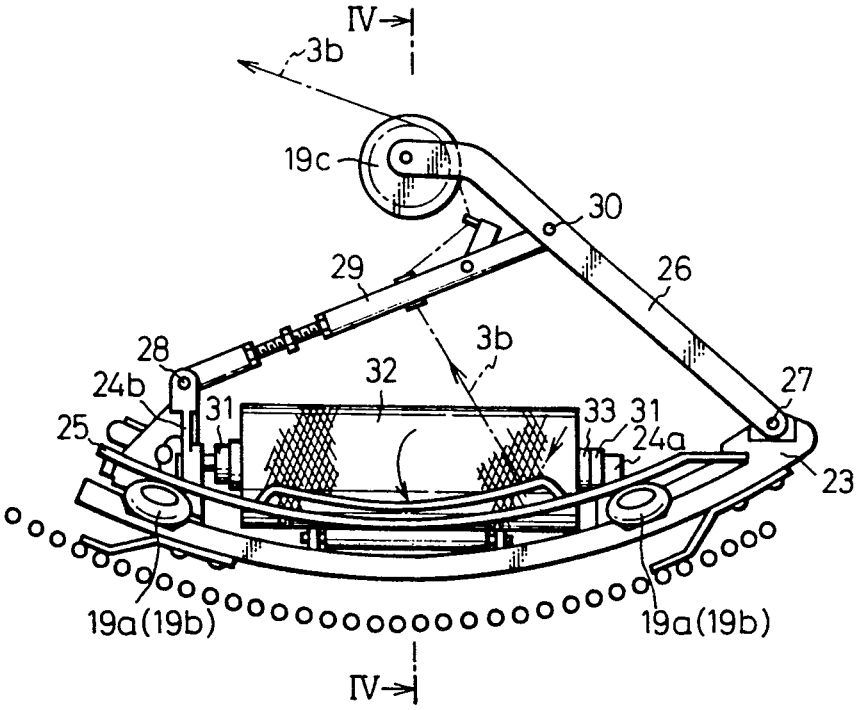
FIG. 3 is a side view of a shuttle utilized for the circular loom shown in FIG. 1.
Figure 4:
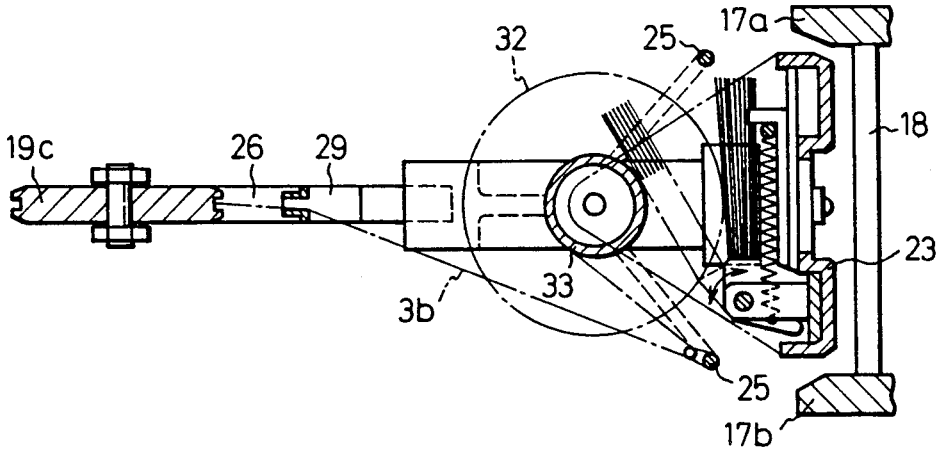
FIG. 4 is a partly sectional schematic front view of the shuttle, taken along the line IV—IV in FIG. 3.

The shuttle 19 comprises a frame shoe 23, FIGS. 3 and 4 provided with a pair of brackets 24*a*, 24*b* projected outward and upward from the shoe 23, a pair of guide wires 25 extending along the longitudinal direction on the frame of shoe 23 at both sides thereof and spaced a uniform distance from the shoe 23, a lever 26 pivoted on the top end portion of the frame of shoe 23 by a pivot pin 27, and an adjustable lever 29 pivoted on a top end portion of the bracket 24*b* by a pivot pin 28 and connected to the lever 26 by a pivot pin 30. A pair of gripping members 31 are mounted on the brackets 24*a*, 24*b*, respectively, to hold a yarn package 32 formed on a bobbin 33 by the shuttle 19. The wheel 19*c* is rotatably mounted on the free end portion of the lever 26, and two pairs of guide wheels 19*a*, 19*b* are rotatably mounted on the forward and rearward end portions of the frame shoe 23 in a condition such that one pair of guide wheels 19*a* is located at one side of the frame shoe 23 while the other pair of guide wheels 19*b* is located at the other side of the frame shoe 23, respectively. As shown in FIGS. 1, 2, and 4, warps 3*a* are supplied from the creels 6 of both sides of the circular loom 1 and are threaded into the respective spaces formed by two adjacent reed elements 18 of the annular reed member 17 rigidly supported by the ring shaped holding member 17*a* and 17*b*, after passing through the respective eyes of the corresponding healds of the shed forming mechanism 14. The shuttles 19, propelled by the shuttle propelling mechanism 15, are inserted in the shed created by the shed forming mechanism 14 in a condition such that the two pairs of the wheels 19*a*, 19*b* are guided by inside annular surfaces thereof so that the guide wheels 19*a*, 19*b* are rotatably guided by the guide surface formed on the respective holding member 17*a*, 17*b*. A weft 3*b*, introduced from the weft yarn package of the bobbin 33, is inserted into the shed and is then inserted by the shed by the wheel 19*c*. Thus a stable weave construction is created to thereby form a tubular fabric 2. The tubular fabric 2 is taken out upwardly via a small annular shaped clearance formed between the horizontal disc guide member 20 and the annular guide 21 and wound on a roll by a take-up mechanism (not shown).

Because the shuttle 19 is inserted into the successive sheds while being guided by and rotating on the guide surfaces of the respective holding members 17*a*, 17*b*, the guide wheels 19*a*, 19*b* press the warp 3*a* against the respective guide surfaces of the corresponding holding members 17*a* and 17*b*. Therefore, if the material of the warp 3*a* has a poor resistance to abrasion, the physical properties of the warp 3*a* are damaged.

The basic technical concept of the present invention is that possible damage due on the mechanical action on the processing warp 3*a* by the shuttles 19, when each shuttle 19 is inserted into the shed, is prevented by providing an annular guide for restricting the running passage of each wheel 19*a*, 19*b* rotatably mounted on the frame shoe 23 of the shuttle 19.

Figure 7:
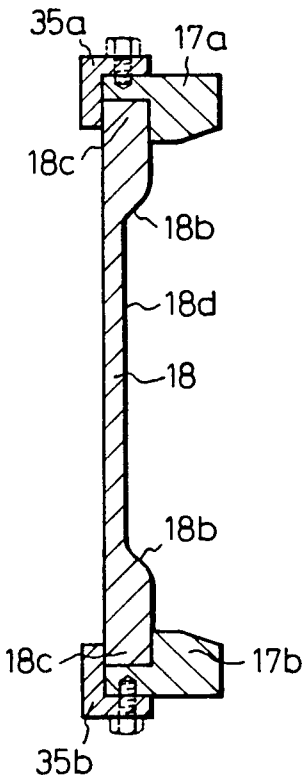
FIG. 7 is a cross sectional side view of the annular reed member, taken along a line VII—VII in FIG. 6.

Referring to FIGS. 6 and 7 indicating an extended condition of the annular reed member 17, a top holding member 17*a*, which normally has a ring shape, and a bottom holding member 17*b*, which normally has a shape identical to that of the top holding member 17*a*, are provided with a plurality of vertical grooves respectively, to support a plurality of reed elements 18 in vertical condition with an identical spacing therebetween. To ensure a stable support of the reed elements 18 by the top and the bottom holding members 17*a*, 17*b*, a pair of annular franges 35*a*, 35*b* are secured to the holding members 17*a*, 17*b*. respectively, as shown in FIGS. 6 and 7, to prevent an escape of each reed element 18 from the corresponding groove of the holding member 17*a* or 17*b*. In this annular reed member 17, the above-mentioned space between two adjacent reed element functions as a slit which permits a free passage of the warp 3*a*, or two or three warp 3*a* in a particular case, to create successive sheds. As shown in FIG. 7, each reed element 18 is provided with top and bottom head portions 18*c* which can be inserted to the respective grooves of the corresponding holding members 17*a*, 17*b* and is provided with a deformed thickness with respect to the radial direction of the annular reed member 17 per se. The above-mentioned thickness is hereinafter referred to as radial thickness. Each reed element 18 is provided with top and bottom end portions 18*c*, and a central portion 18*a* between the end portions 18*c* is larger than that of the central portion 18*a*, whereby a pair of inclined surface portions 18*b* are formed between the central portion 18*a* and each respective end portion 18*c*. In this embodiment, preferably these inclined surface portions 18*b* are symmetrical to the space between the top holding member 17*a* and the bottom holding member 17*b*. Further since each reed element 18 is provided with the above-mentioned shape, a pair of inclined annular surfaces, which are symmetrically facing each other, are formed on the assembled reed elements 18 of the annular reed member 17. The positions of the above-mentioned inclined annular surfaces are designed in such a manner that these inclined annular surfaces create an annular guide groove 18*d* which functions to restrict the allowable ring-shaped running passage of the wheels 19*a*, 19*b* of each shuttle 19. It is important to carefully select the location of the above-mentioned annular guide groove 18*d*, to attain the object of the present invention. Namely, to prevent any possibility of a pressing against the warp 3*a* by the wheels 19*a*, 19*b* the distance of the inclined surface portion 18*a*from the inside edge of the top holding member 17*a*, and the distance of the inclined surface portion 18*b* from the inside edge of the bottom holding member 17*b*, should be such that possible contact of the warp 3*a* by the wheels 19*a*, 19*b* is prevented, because the above-mentioned edges of both holding members 17*a*, 17*b* function to define the passage of the warp 3*a* of the open shed.

As mentioned above, in the first embodiment of the present invention provided with the above-mentioned annular reed member 18, since the running passage of the shuttle 19 is always restricted by the above-mentioned defined ring shaped running passage, any contact between the warp 3*a* and the wheels 19*a*, 19*b* of the shuttles 19 can be completely prevented.

According to the above-mentioned technical concept of the present invention, several modifications of the annular guide passage for restricting the running passage of the above-mentioned wheels of the shuttle, are provided.

Figure 9:
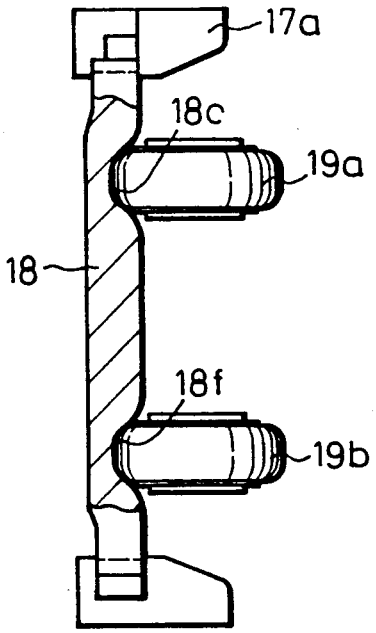

Namely, as shown in FIG. 9, instead of forming a pair of inclined surfaces to create an annular guide groove for defining the running passage of the wheels 19*a*, 19*b* of the shuttles 19 in the circular loom, as in the first embodiment, a pair of annular guide grooves 18*e* and 18*f* are formed in the annular reed member 17 such that the positions of these guide grooves 18*e* and 18*f* are located, respectively, at positions at which the corresponding wheels 19*a*, 19*b* of each shuttle 19 can be smoothly received. In this embodiment, as in the first embodiment, each reed element 18 has an identical shape having a deformed radial thickness which corresponds to the above-mentioned guide grooves 18*e*, 18*f*, in the same condition as the above-mentioned first embodiment, with respect to the positions thereof.

Figure 10:
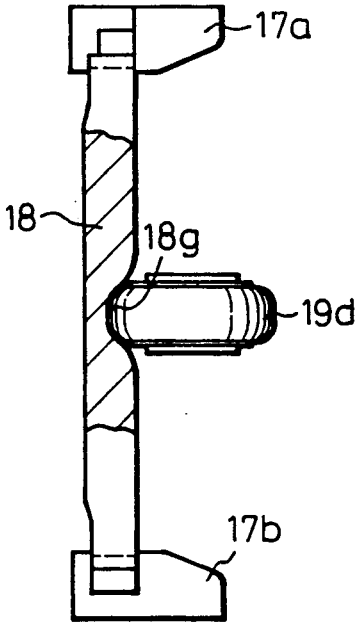

Therefore if a shuttle having a shape such that the pair of guide wheels 19*d* are rotatably mounted on the frame shoe at a forward and a rearward end portion of thereof is utilized, as shown in FIG. 10, a single annular guide groove is formed in the annular reed member 17 at the central thereof with respect to the axial direction of the circular loom, to thereby attain the object of the present invention. In this third embodiment, each reed element 18 is provided with a shape having a radial thickness such that a recess 18*g* is formed at the center of the reed element 18 with respect to the axial direction of the circular loom 1, so that the above-mentioned annular groove defining the running passage of the wheels 19*d* of the shuttle is created. In these second and third embodiments, the dimensional and positional relationships between the guide groove or grooves and the annular holders are similar to those of the first embodiment, and therefore, an explanation thereof is omitted.

As mentioned above, the mechanism for guiding shuttles in the circular loom according to the present invention can be effectively utilized to produce a tubular fabric for mechanical use, particularly to produce a tubular fabric made of a textile material having brittle fibers such as carbon or glass fibers, because possible damage to the warps, due to the pressing of the warp against a solid substance such as the annular flange of a reed member by the wheel of the shuttle can be absolutely prevented.

I claim:

1. A mechanism for guiding shuttles in a circular loom, wherein shuttles provided with a plurality of rotatable supporting wheels are moved along a circular running passage and a weft taken out from each shuttle is inserted into successive sheds of warps created immediately before the arrival of said shuttle so that said weft is interwoven with said warps to form a tubular fabric, comprising:

an annular reed member provided with said circular running passage for restricting a passage of said supporting wheels of said shuttle, said annular reed member comprising an upper annular holding member and a lower annular holding member, a plurality of vertical reed elements rigidly supported by said upper and lower holding members with an identical spacing therebetween for allowing a free passage of said warp between two adjacent reed elements, each of said reed elements being provided with a particular cross sectional shape with regard to an axial center of said annular reed member, said cross sectional shape being provided with at least one guide surface for guiding a corresponding one of said supporting wheels of said shuttle at a position separated from said upper and lower annular holding members by a predetermined distance, said running passage of said shuttle being defined by said guide surfaces of said reed elements of said annular reed member said predetermined distance of said guide surface of said reed elements being designed to prevent any pressing of said warps against said annular holding member by said supporting wheels, whereby said shuttles are able to run on said circular passage without damaging said warps by said supporting wheels of each of said shuttles.

2. A mechanism for guiding shuttles in a circular loom according to claim 1, wherein said reed element is provided with a pair of said guide surfaces formed at respective positions separated from a corresponding one of said annular holding members by said predetermined distance, each of said guide surfaces being an inwardly inclined surface with respect to a central portion of said reed element.

3. An improved mechanism for guiding shuttles in a circular loom according to claim 1, wherein said reed element is provided with a pair of recessed surfaces formed at respective positions separated from said predetermined distance from said upper and lower annular holding members respectively, said recessed surfaces receive corresponding one of said supporting wheels.

4. A mechanism for guiding shuttles in a circular loom according to claim 1, wherein said reed element is provided with said guide surface formed at a central position thereof, said guide surface being a recessed surface for receiving said supporting wheels.

* * * * *